US007469645B2

(12) United States Patent
Mangano et al.

(10) Patent No.: US 7,469,645 B2
(45) Date of Patent: Dec. 30, 2008

(54) MODULAR FOLDING TABLES

(75) Inventors: Joy Mangano, St. James, NY (US); Brian Scevola, Bohemia, NY (US)

(73) Assignee: Ingenious Designs, LLC, Edgewood, NY (US)

( * ) Notice: Subject to any disclaimer, the term of this patent is extended or adjusted under 35 U.S.C. 154(b) by 209 days.

(21) Appl. No.: 10/980,222

(22) Filed: Nov. 3, 2004

(65) Prior Publication Data

US 2006/0090675 A1 May 4, 2006

(51) Int. Cl.
*A47B 3/00* (2006.01)
*A47B 57/00* (2006.01)

(52) U.S. Cl. ..... 108/115; 108/64

(58) Field of Classification Search ..... 108/121–132, 108/115, 59, 64, 49, 162, 179; 248/188, 248/188.1, 188.6, 188.8, 188.9, 188.91
See application file for complete search history.

(56) References Cited

U.S. PATENT DOCUMENTS

| | | | | | |
|---|---|---|---|---|---|
| 747,683 | A | | 12/1903 | Clark | |
| 793,255 | A | | 6/1905 | Williams | |
| 793,256 | A | | 6/1905 | Williams | |
| 1,905,862 | A | * | 4/1933 | Harman | 108/125 |
| 2,619,394 | A | | 11/1952 | Mahr | |
| 2,836,475 | A | | 5/1958 | Sapp | |
| 2,879,118 | A | * | 3/1959 | Kolb | 108/115 |
| 3,240,170 | A | * | 3/1966 | Shave | 108/32 |
| 3,342,147 | A | | 9/1967 | Shettles | |
| 3,361,088 | A | * | 1/1968 | Hodgkin | 108/12 |
| 3,709,159 | A | * | 1/1973 | Oglesby, Jr. | 108/44 |
| 3,915,100 | A | | 10/1975 | Sullivan | |
| 3,954,068 | A | * | 5/1976 | Roberts et al. | 105/124 |
| 4,938,153 | A | * | 7/1990 | Maes | 108/128 |
| D331,505 | S | * | 12/1992 | Sylvester | D6/429 |
| 5,182,996 | A | | 2/1993 | Gutgsell | |
| 5,341,749 | A | | 8/1994 | Noakes | |
| 5,794,545 | A | | 8/1998 | McDaniel et al. | |
| 6,182,580 | B1 | * | 2/2001 | Barrett et al. | 108/64 |

FOREIGN PATENT DOCUMENTS

DE 3610232 A1 * 10/1987

* cited by examiner

*Primary Examiner*—Janet M Wilkens
*Assistant Examiner*—Timothy M Ayres
(74) *Attorney, Agent, or Firm*—Galgano & Associates, PLLC

(57) ABSTRACT

Folding modular tables include a square table top and hinged vertical supports with hinged horizontal feet. Four coupling members are arranged under the table top, three of one gender and one of the other gender. Two preferred embodiments are provided: one has three male coupling members and one female, the other has three female and one male. By providing these two embodiments, the tables can be coupled to each other in a variety of configurations with the vertical supports and horizontal feet all aligned in such a way as to facilitate the placement of chairs under the table tops.

2 Claims, 7 Drawing Sheets

MODULAR FOLDING TABLES

BACKGROUND OF THE INVENTION

1. Field of the Invention

The invention relates to folding tables. More particularly, the invention relates to modular folding tables which can be connected to each other in a variety of configurations.

2. Brief Description of the Prior Art

Modular tables have been known in the art for many years. Some of these tables are designed to be used with chairs and some are not. With regard to the tables intended to be used with chairs, the location of the table legs becomes an issue. It is important that the table legs be arranged so as to allow a chair to be pulled up underneath the table. This is not so difficult with a single table but with modular connecting tables, it can become a challenge.

SUMMARY OF THE INVENTION

It is therefore an object of the invention to provide modular folding tables.

It is also an object or the invention to provide modular folding tables which have leg arrangements that permit chairs to be pulled up under the tables.

It is another object of the invention to provide modular folding tables which cap be connected to each other in a number of different configurations.

Certain of the foregoing and related objects are also attained in a modular table, comprising a square table top; at least one vertical support coupled to said table top; and four coupling members, each being centrally located adjacent an edge of said table top, three of said coupling members being of one gender and one being of the other gender.

Most desirably, said at least one vertical support includes two vertical supports coupled off center to said table top. The vertical supports are preferably hingedly coupled to said table top. Most advantageously, the table includes two horizontal feet, one coupled to each vertical support. Most desirably, the feet are hingedly coupled to said vertical supports. Preferably, the table further includes at least one cross member coupling said vertical supports to each other and at least one cross member coupling said feet to each other. The table advantageously further comprises four folding struts, one coupling each vertical support to said table top and one coupling each foot to a respective vertical support.

In a preferred embodiment, the tables include a square top hingedly coupled to a pair of vertical supports close to one side of the square top and a pair of horizontal feet hingedly coupled to the bottom of the vertical supports and extending substantially the entire width of the table top. The vertical supports are preferably coupled to each other by at least one cross member as are the horizontal feet. A pair of folding struts are coupled between the table top and the vertical supports and a similar pair of struts are coupled between the vertical supports and the horizontal feet. When the struts are folded, the table top and horizontal feet can be folded toward the vertical supports resting substantially parallel thereto, forming a more compact configuration for storage.

According to a preferred embodiment of the invention, table coupling members are centrally located under each edge of the table top. The table coupling members are either male or female and two table embodiments are provided. In one embodiment, the table top is provided with three female coupling members and one male coupling member. In the other embodiment, the table top is provided with three male coupling members and one female coupling member. By providing these two embodiments, the tables can be coupled to each other in a variety of configurations with the vertical supports and horizontal feet all aligned in such a way as to facilitate the placement of chairs under the table tops. Four types of table configurations are shown as examples: straight line, square, L-shape and T-shape. Further according to the invention, the tables are sold in a set of four, two of each embodiment, and, optionally, a set of table cloths for each of several configurations are included with the set.

In a further preferred embodiment, a modular table kit is provided which includes a plurality of tables of a first type and at least one table of a second type, said tables of said first type having a square table top, at least one vertical support coupled to said table top, and four coupling members, each being centrally located adjacent an edge of said table top, three of said coupling members being of a first gender and one being of a second gender; and said tables of said second type having a square table top, at least one vertical support coupled to said table top, and four coupling members, each being centrally located adjacent an edge of said table top, one of said coupling members being of the first gender and three being of the second gender. Preferably the kit further comprises a plurality of table cloths, each being seamed to neatly fit a different configuration of said tables coupled together. Advantageously, with regard to all of the tables, said at least one vertical support includes two vertical supports mounted off center. Desirably each vertical support has a horizontal foot, each vertical support is hingedly coupled to a respective table top, and each foot is hingedly coupled to a respective vertical support. Most advantageously, the kit further comprises with regard to each table, four folding struts, one coupling each vertical support to the table top and one coupling each foot to a respective vertical support. Most desirably, the kit further comprises with regard to each table, at least one cross member coupling vertical supports to each other and with regard to each table, at least one cross member coupling the feet to each other.

DETAILED DESCRIPTION

Figure 1:
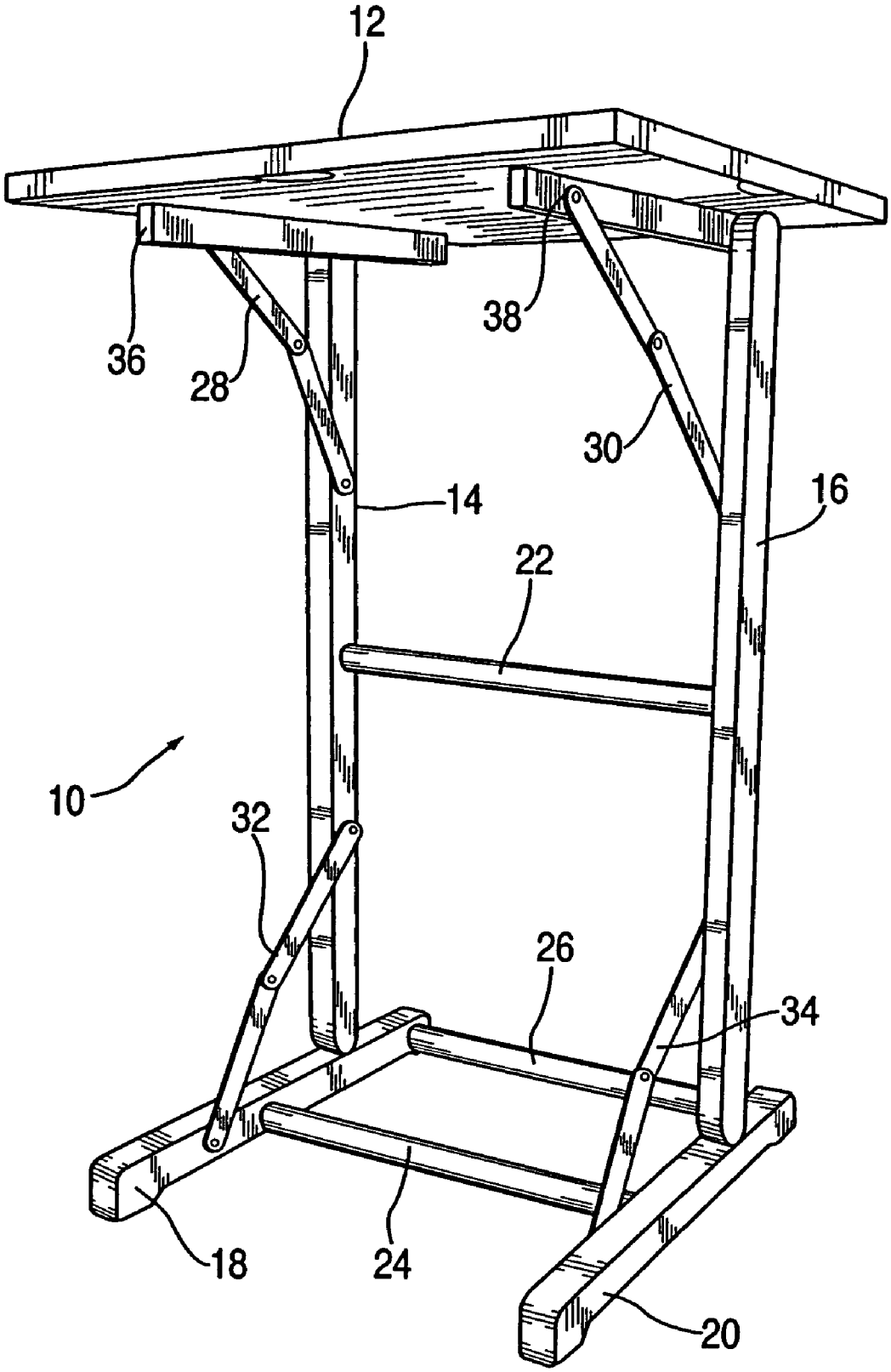
FIG. 1 is a perspective view of a table according to the invention.
Figure 2:
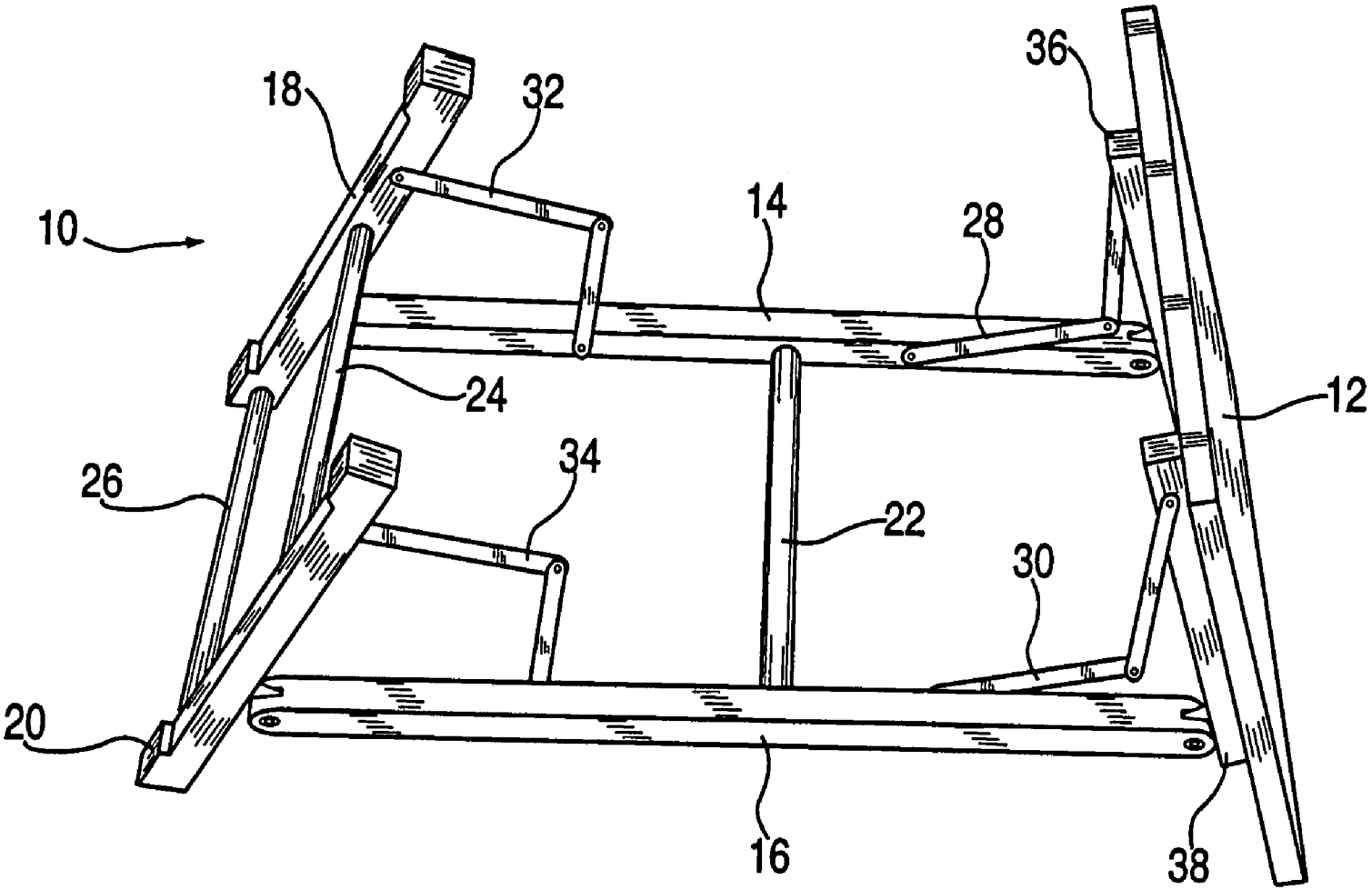
FIG. 2 is a perspective view of the table partially folded.
Figure 3:
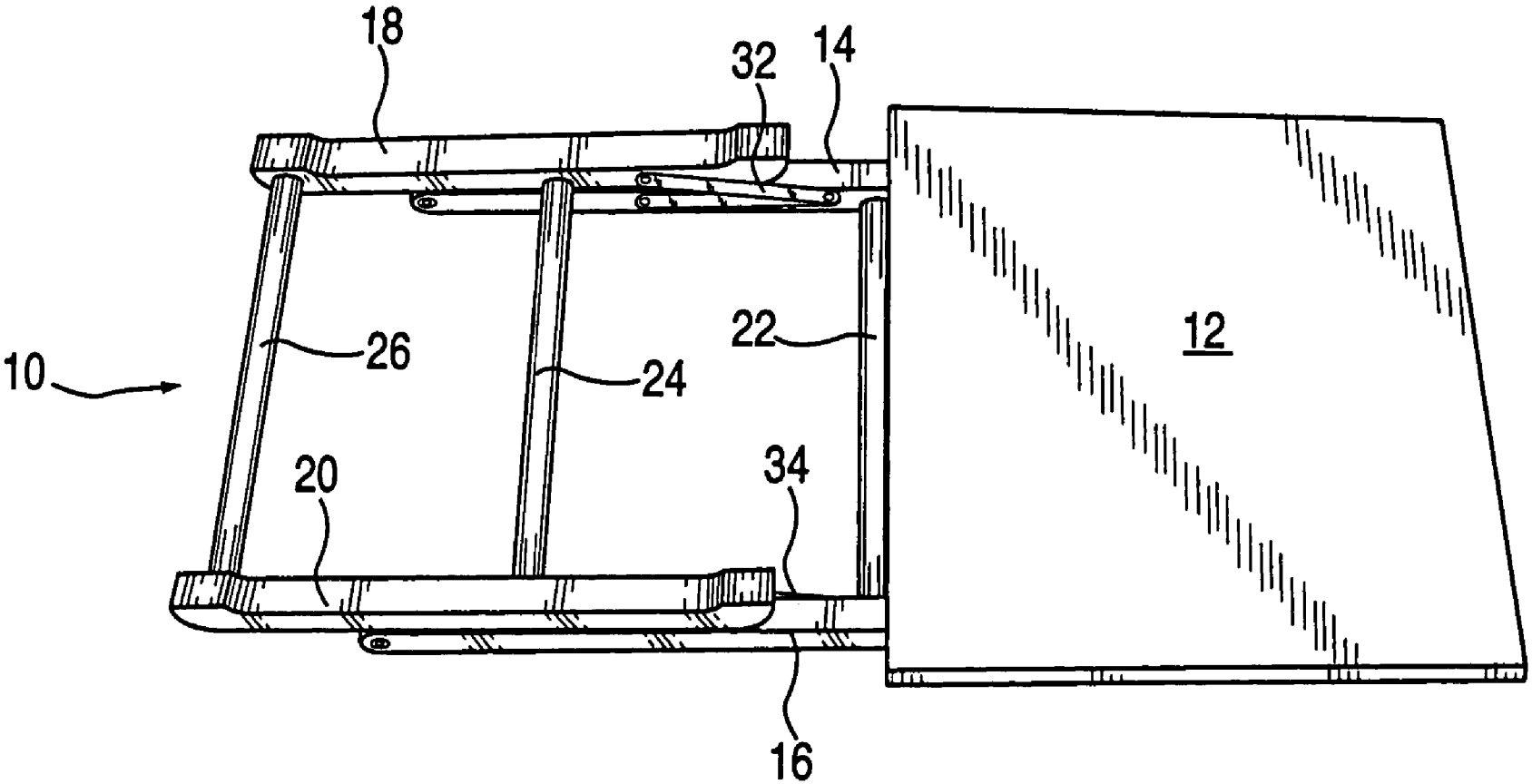
FIG. 3 is a perspective view of the table completely folded.

Turning now to FIGS. 1-3, a table 10 according to the invention includes a square top 12 hingedly coupled to a pair of vertical supports 14, 16 close to one side of the square top 12 and a pair of horizontal feet 18, 20 hingedly coupled to the bottom of the vertical supports 14, 16 and extending substantially the entire width of the table top. The vertical supports 14, 16 ere preferably coupled to each other by at least one cross member 22 and the horizontal feet 18, 20 are preferably coupled to each other by two cross members 24, 26. A pair of folding struts 28, 30 are coupled between the table top 12 and the vertical supports 14, 16 and a similar pair of struts 32, 34 are coupled between the vertical supports 14, 16 and the horizontal feet 18, 20. As illustrated, the vertical supports 14, 16 and the folding struts 28, 30 are coupled to the table top 12 via a pair of perpendicular table top supporting members 36, 38.

As seen in FIGS. 2 and 3, when the struts 28, 30, 32, 34 are folded, the table top 12 and horizontal feel 18, 20 can be folded toward the vertical supports 14, 16 resting substantially parallel thereto, forming a more compact configuration for storage.

Figure 4:
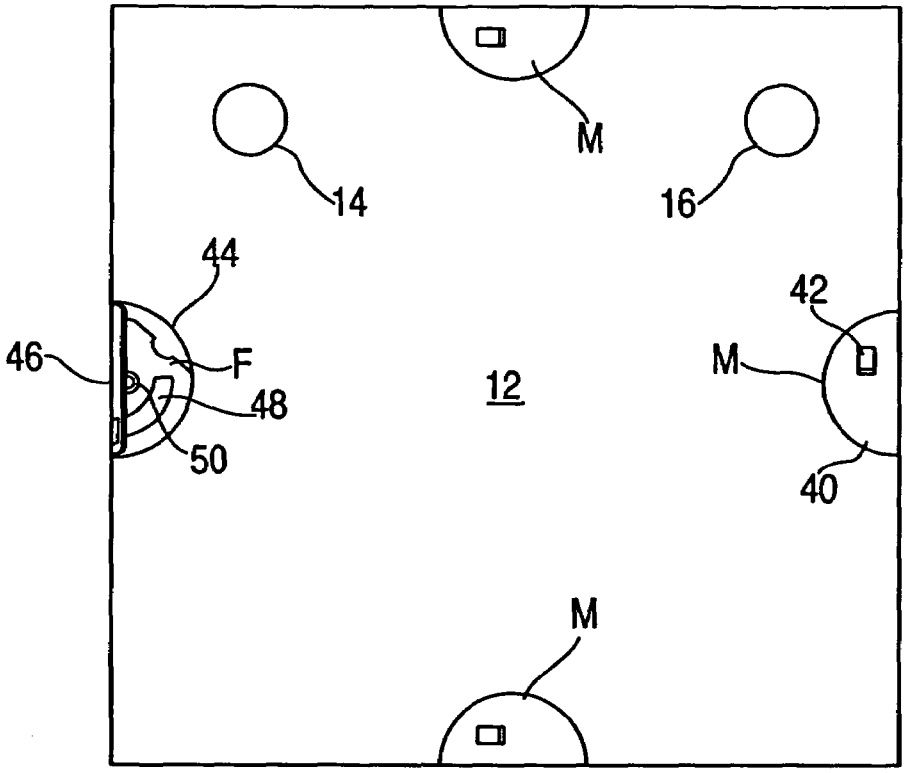
FIG. 4 is a transparent plan view of a first embodiment of a table according to the invention.

According to the invention table coupling members are centrally located under each edge of the table top. The table coupling members are either male or female and two table embodiments are provided. FIG. 4 illustrates one embodiment where the table top 12 is provided with three male coupling members M and one female coupling member F. As illustrated, the male coupling member M comprises a semicircular plate 40 which has been punched and bent to exhibit an upstanding central flange 42. The female coupling member 44 is a semicircular plate 44 which has been punched and bent to exhibit an upstanding edge flange 46 and a curved slot 48. The female coupling member F is rotatable about a pivot 50.

Figure 5:
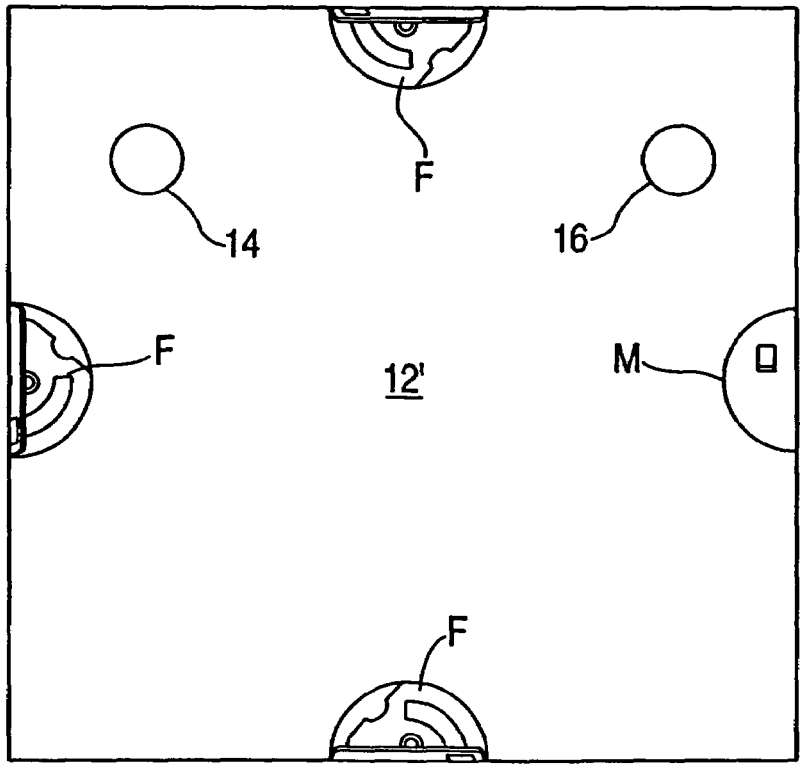
FIG. 5 is a transparent plan view of a second embodiment of a table according to the invention.

FIG. 5 illustrates the other embodiment of a table according to the invention where the table top 12' Is provided with three female coupling members F end one male coupling member M. Although R particular male and female coupling member construction has been shown, it will be appreciated that different types of male and female coupling members could be used so long as there are three of one gender and one of the other gender.

Figure 6:
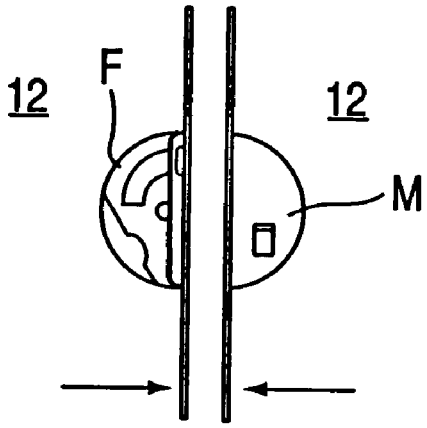
FIGS. 6-8 illustrate the steps of connecting male and female coupling members.
Figure 7:
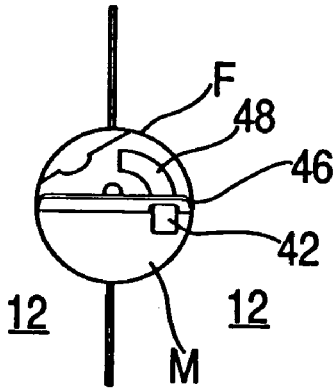
Figure 8:
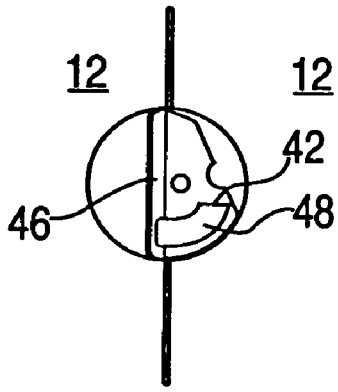

FIGS. 6-8 show how the exemplary male and female coupling members are used to connect tables to each other. As shown in FIG. 6, two table tops are brought edge to edge with male and female coupling members aligned. As shown in FIG. 7, the flange 46 of the female coupling member F is grasped with finger and thumb and twisted to cause the female coupling member to rotate with the curved slot 48 engaging the upstanding flange 42 of the male coupling member. Twisting is completed as shown in FIG. 8. The curved slot 48 may be designed to provide a camming action which forces the edges of the table tops together. It will also be appreciated that the table tops could be provided with a tongue and groove configuration to assure that the combined table tops present a smooth continuous surface.

Figure 9:
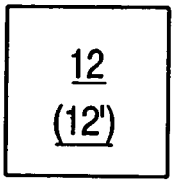
FIGS. 9-16 are schematic transparent views illustrating different configurations of connected tables.
Figure 10:
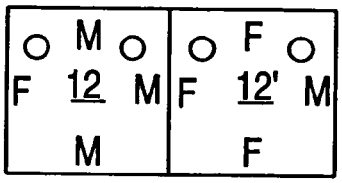
Figure 11:
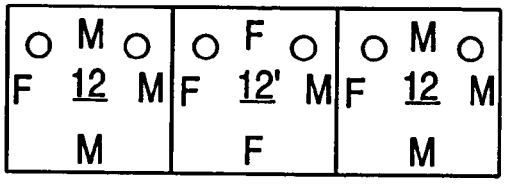
Figure 12:
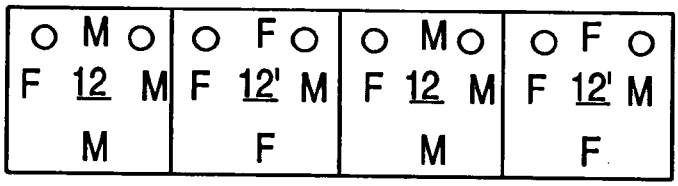
Figure 13:
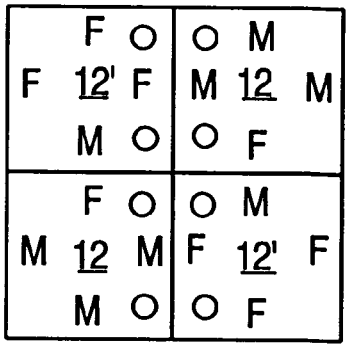
Figure 14:
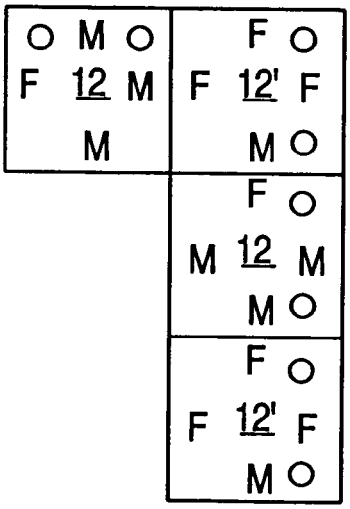
Figure 15:
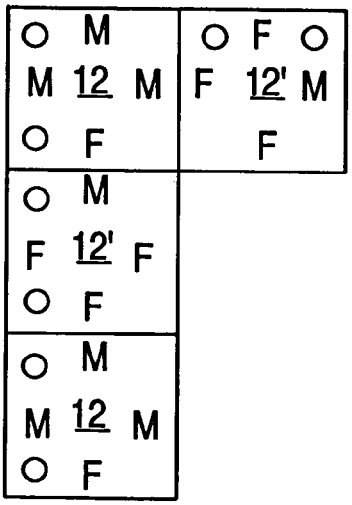
Figure 16:
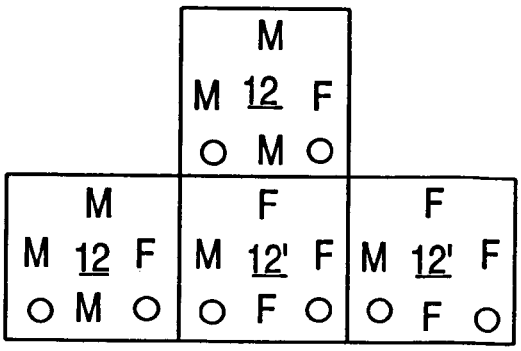

FIGS. 9-16 illustrate several ways in which the tables can be coupled to each other. These figures are schematic views of the tops of the tables with the locations of the male coupling members illustrated by M, the female couplings illustrated by F and the location of the vertical supports illustrated by O. FIG. 9 simply shows that one table of either embodiment can be used alone. FIGS. 10-12 show than an unlimited number of tables can be coupled in a row with the vertical supports all on one side to allow chairs to fit an the other side by using alternating embodiments 12, 12'. FIG. 13 shows how two tables having tops 12 and 12' can be coupled to each other and to two tables having tops 12 and 12' resulting in a square with the vertical supports of all the tables in the center close together. FIGS. 14 and 15 show left and right L-shaped configurations using two table tops 12 and two 12'. FIG. 16 shows a T-shaped configuration which is formed with two table tops of each type. It will therefore be appreciated that with a set of four tables, two of each type, all of the configurations shown in FIGS. 9-16 can be arranged.

Figure 17:
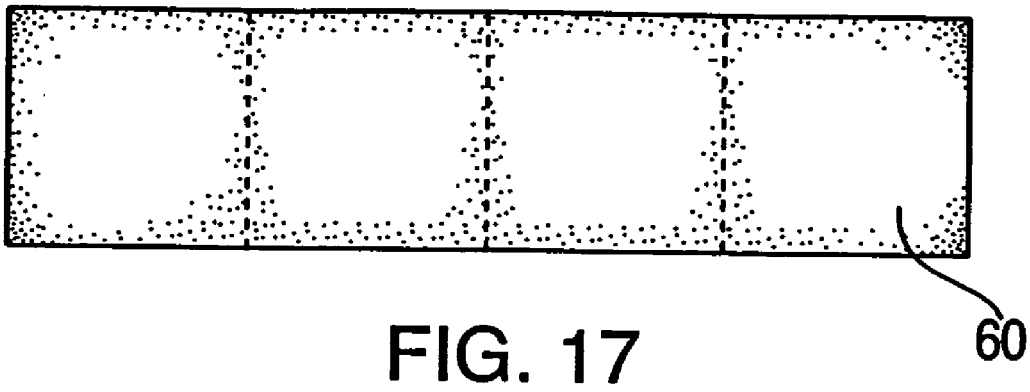
FIGS. 17 and 18 illustrate different tablecloths configured to match the table configurations of FIGS. 12 and 14 respectively.
Figure 18:
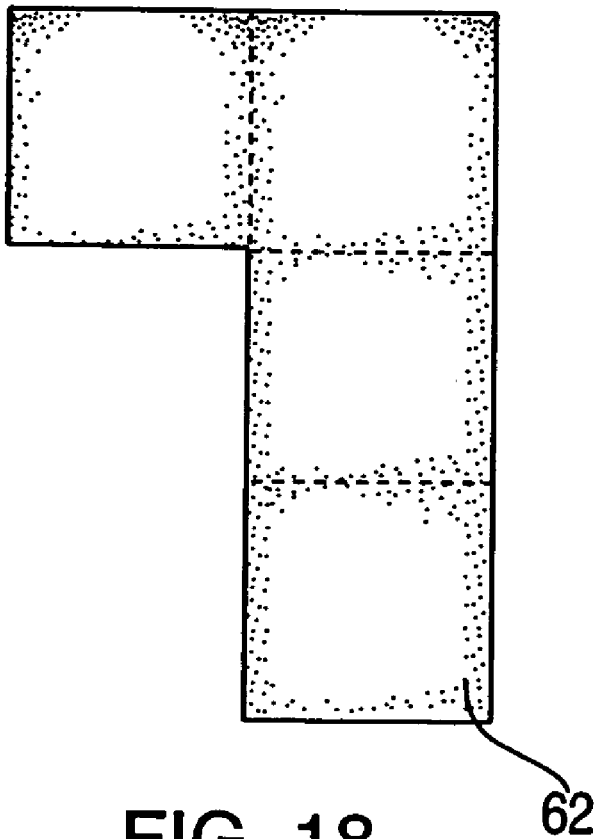

According to another aspect of the invention, the tables are packaged in a set together with a number of different table cloths, each being seamed to fit neatly over a different configuration of attached tables. Two examples of these tablecloths are shown in FIGS. 17 and 18 which respectively show a tablecloth 60 designed for the table configuration of FIG. 12 and a tablecloth 62 designed for the table configuration of FIG. 14. Of course other configurations can be used to match other table configurations.

There have been described and illustrated herein embodiments of modular folding tables. While particular embodiments of the invention have been described, it is not intended that the invention be limited thereto, as it is intended that the invention be as broad in scope as the art will allow and that the specification be read likewise. For example, although the mechanical, interlocking male-female locking means described and illustrated above are most advantageous, other locking means (e.g., Velcro fasteners) may possible bed be employed to suit other applications. It will therefore be appreciated by those skilled in the art that yet other modifications could be made to the provided invention without deviating from its spirit and scope as so claimed.

What is claimed is:

1. A modular table kit, comprising:

a plurality of tables of a first type and at least one table of a second type, said tables of said first and second type having:

a square table top having a front edge, a rear edge and two side edges, two spaced-apart vertical supports each having a top end and a bottom end and a front side and a rear side, said top ends each being hingeably coupled to each of said table tops adjacent to, but spaced from, said rear edge thereof and an opposite side edge thereof, and a pair of spaced-apart horizontal feet each having a front end and a rear end wherein each foot is hingedly coupled to a different one of said bottom ends of said vertical supports, adjacent to, but spaced from, said rear end thereof for movement between an open position, in which said feet are horizontally disposed entirely beneath said table top for supporting said table in an upright position with said table top in a horizontally-extending position, with its rear edge extending rearwardly of said vertical supports, and a collapsed position, in which said feet are folded upwardly and abut said front side of said vertical supports and said table top is folded downwardly and abuts said front side of said vertical supports next to said folded feet but spaced therefrom to form a more compact configuration for storage, and wherein, when in said open position, said vertical supports are positioned to be connected to said feet between said ends thereof and wherein said rear ends extend outwardly and rearwardly from the location where said bottom ends of said vertical supports are coupled to said feet;

only four mechanically interlocking, male-female coupling members, with a single one of each of said coupling members being located exactly at the center of a different side edge of said table top, said tables of said first type having three of said coupling members being of a first gender and one being of a second gender and said tables of said second type having one of said coupling members being of the first gender and three being of the second gender;

at least one first cross member coupling said vertical supports to each other;

at least one second cross member coupling said feet to each other, wherein said second cross member is connected to said feet at a location generally centrally located on said feet, between said ends of said feet, wherein a space is created forwardly of said second cross member wherein a person can sit with their legs and feet disposed beneath said table top and forwardly of said second cross member; and two pairs of folding struts, one pair coupling said vertical supports to said table top and the other pair coupling said feet to said vertical support to permit movement of said table from said open position to said collapsed position, wherein at least one table of a first type has one coupling member of one gender engaged with a second coupling member having an opposite gender on a table selected from one of a first type or of a second type such that the two tables are brought together with the respective edges butted together.

2. The kit according to claim 1, further comprising:

a plurality of table cloths, each being seamed to neatly fit a different configuration of said tables coupled together.

* * * * *